US007148780B2

(12) United States Patent
Skinner et al.

(10) Patent No.: US 7,148,780 B2
(45) Date of Patent: Dec. 12, 2006

(54) TWIN SPARK PENCIL COIL

(75) Inventors: Albert Anthony Skinner, El Paso, TX (US); Colin Hamer, El Paso, TX (US); Mark Albert Paul, El Paso, TX (US); Harry Oliver Levers, Jr., El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 24 days.

(21) Appl. No.: 11/041,004

(22) Filed: Jan. 24, 2005

(65) Prior Publication Data

US 2006/0164196 A1 Jul. 27, 2006

(51) Int. Cl.
*H01F 27/02* (2006.01)

(52) U.S. Cl. ..... 336/90; 336/92; 123/634

(58) Field of Classification Search ..... 336/92, 336/90, 96, 62; 123/634–635
See application file for complete search history.

(56) References Cited

U.S. PATENT DOCUMENTS

| | | | | |
|---|---|---|---|---|
| 4,177,782 A | | 12/1979 | Yoshinari et al. | 123/148 C |
| 4,493,306 A | * | 1/1985 | Asik | 123/620 |
| 5,146,905 A | | 9/1992 | Davis | 123/599 |
| 5,146,906 A | | 9/1992 | Agatsuma | 123/634 |
| 5,806,505 A | | 9/1998 | Herbert | 123/621 |
| 6,232,863 B1 | | 5/2001 | Skinner | 336/182 |
| 6,463,918 B1 | | 10/2002 | Moga | 123/633 |
| 6,474,322 B1 | * | 11/2002 | Ubukata et al. | 123/634 |
| 6,522,232 B1 | | 2/2003 | Paul | 336/92 |
| 6,556,118 B1 | | 4/2003 | Skinner | 336/182 |
| 6,666,196 B1 | | 12/2003 | Skinner | 123/655 |
| 6,724,289 B1 | | 4/2004 | Moga et al. | 336/90 |

FOREIGN PATENT DOCUMENTS

| | | |
|---|---|---|
| DE | 3730291 A1 | 3/1988 |
| DE | 19508268 A1 | 9/1996 |
| JP | 2001-304081 | 10/2001 |
| JP | 2001-355554 | 12/2001 |

OTHER PUBLICATIONS

Skinner et al, U.S. Appl. No 10/976,045, filed Oct. 28, 2004, "Ignition Coil with Secondary Winding Center Tap Connected to Shield".
EP 06 07 5074, European Search Report Dated Apr. 28, 1006.

* cited by examiner

*Primary Examiner*—Anh Mai
(74) *Attorney, Agent, or Firm*—Paul L. Marshall

(57) ABSTRACT

An ignition apparatus having twin spark high-voltage outputs incorporates features of a pencil coil wherein at least a portion of a transformer assembly is disposed within a spark plug well when installed in an internal combustion engine, thereby reducing the space required on the top of the engine. A secondary winding spool is configured to retain a secondary winding in first and second portions, wound either the same way for use in waste spark ignition systems or in opposite orientations for two-plug-per-cylinder systems. An alternate configuration includes an isolated shield that is internal to the case.

17 Claims, 5 Drawing Sheets

TWIN SPARK PENCIL COIL

BACKGROUND OF THE INVENTION

1. Technical Field

The present invention relates generally to an ignition apparatus or coil, and, more particularly, to a twin spark pencil coil.

2. Discussion of the Background Art

An ignition apparatus for producing a spark for ignition of an internal combustion engine has been developed in a variety of different configurations suited for the particular application desired. For example, it is known to provide an ignition apparatus that utilizes a secondary winding wound in a progressive winding pattern, specifically for "pencil" coil applications. A pencil coil is one having a relatively slender configuration adapted for mounting directly to a spark plug in a spark plug well of an internal combustion engine. A feature of a "pencil" coil is that a substantial portion of the transformer (i.e., a central core and primary and secondary windings) is located within the spark plug well itself, thereby improving space utilization in an engine compartment. In one configuration, an outer core or shield is allowed to electrically float, as seen by reference to U.S. Pat. No. 6,463,918 issued to Moga et al. entitled "IGNITION APPARATUS HAVING AN ELECTRICALLY FLOATING SHIELD."

It is also known to provide an ignition apparatus that provides a pair of high voltage outputs suitable for generating a spark to a pair of different spark plugs. In such a known product, however, the transformer portion is not mounted within the spark plug well like a pencil coil, but rather is mounted outside of and above the spark plug well and has been refer red to as a plug top coil. The known plug top ignition coil employs one long boot to mate to the spark plug and includes a second tower that provides a high voltage suitable for generating a spark to another spark plug. The high voltage produced on the second tower may go to a mated cylinder undergoing an exhaust stroke (i.e., at the same time as the principal cylinder is undergoing a compression stroke—a so-called "waste" spark ignition system). Alternatively, the high voltage on the second tower may go to a second spark plug in the same cylinder. The latter arrangement may employ a center-tapped secondary winding, with a first portion of the secondary winding being wound in an opposite direction relative to a second, remaining portion of a secondary winding. This opposite winding orientation coupled with a center tap going to ground provides two negative sparks to two spark plugs which may be installed in the same cylinder. A problem with the plug top ignition coil for twin spark operation however, relates packaging. Specifically, a relatively large area above one of the two spark plug wells is needed in order to mount the plug top ignition coil. In addition, an extra bracket may be needed, which can increase cost and complexity.

There is therefore a need for an ignition apparatus or coil that minimizes or eliminates one or more of the problems as set forth above.

SUMMARY OF THE INVENTION

An object of the present invention is to solve one or more of the problems set forth in the Background. One advantage of the present invention is that it provides an ignition apparatus suitable for use in a twin spark application, but that uses a reduced amount of space as compared to known twin spark ignition coil configurations. Known plug top ignition coil configurations suitable for twin spark applications use more space above the spark plug well and often require an additional bracket for mounting, which increase cost relative to that of the present invention. An ignition apparatus according to the invention incorporates features that provide twin spark functionality with a reduced space usage and cost.

An ignition apparatus according to the invention is configured for mounting in a spark plug well in an engine. The ignition apparatus includes a transformer assembly and a case. The transformer assembly includes a central core and a primary and a secondary winding. The core is elongated and has a main axis. The primary and secondary windings are located outwardly of the central core. The case is configured to house the transformer assembly such that a portion of the transformer assembly is within the spark plug well when the ignition apparatus is installed in the engine. This provides for improved space utilization. The case further includes a first high-voltage (HV) connection at a first end (e.g., lowermost end) configured for direct mounting to a spark plug. The case also includes a second HV connection at a second end that is axially opposite the first end.

In a preferred embodiment, the ignition apparatus includes a secondary spool configured to receive and retain the secondary winding wherein the secondary winding is wound in a progressive winding pattern.

In a still further embodiment, the case includes an axially-extending, generally annular body portion and further includes a trough disposed outwardly of the body and defines a channel through which a center tap conductor extends. In this embodiment, the secondary spool includes first and second winding bays wound with first and second portions of the secondary winding. The first portion is wound in one of a clockwise (CW) and counter-clockwise (CCW) orientation. The second portion is wound in the other one of the CW and CCW orientation. The center tap conductor is coupled to a center tap node between the first and second portions of the secondary winding. The trough is arranged, relative to the annular body, so that the center tap conductor does not fall inside of the inside diameter (ID) of the shield, which positioning dramatically reduces the electric field concentration eminating from the center tap conductor as it passes to the high voltage end of the secondary winding (i.e., at the top end of the ignition apparatus). In one embodiment, the shield is notched so as to allow for, and not interfere with, the center tap conductor.

In a still further embodiment, the ignition apparatus is provided with an isolated, internal shield, which is disposed in a shield chamber defined between inner and outer walls of the case. In this further embodiment, the shield may be allowed to electrically float.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
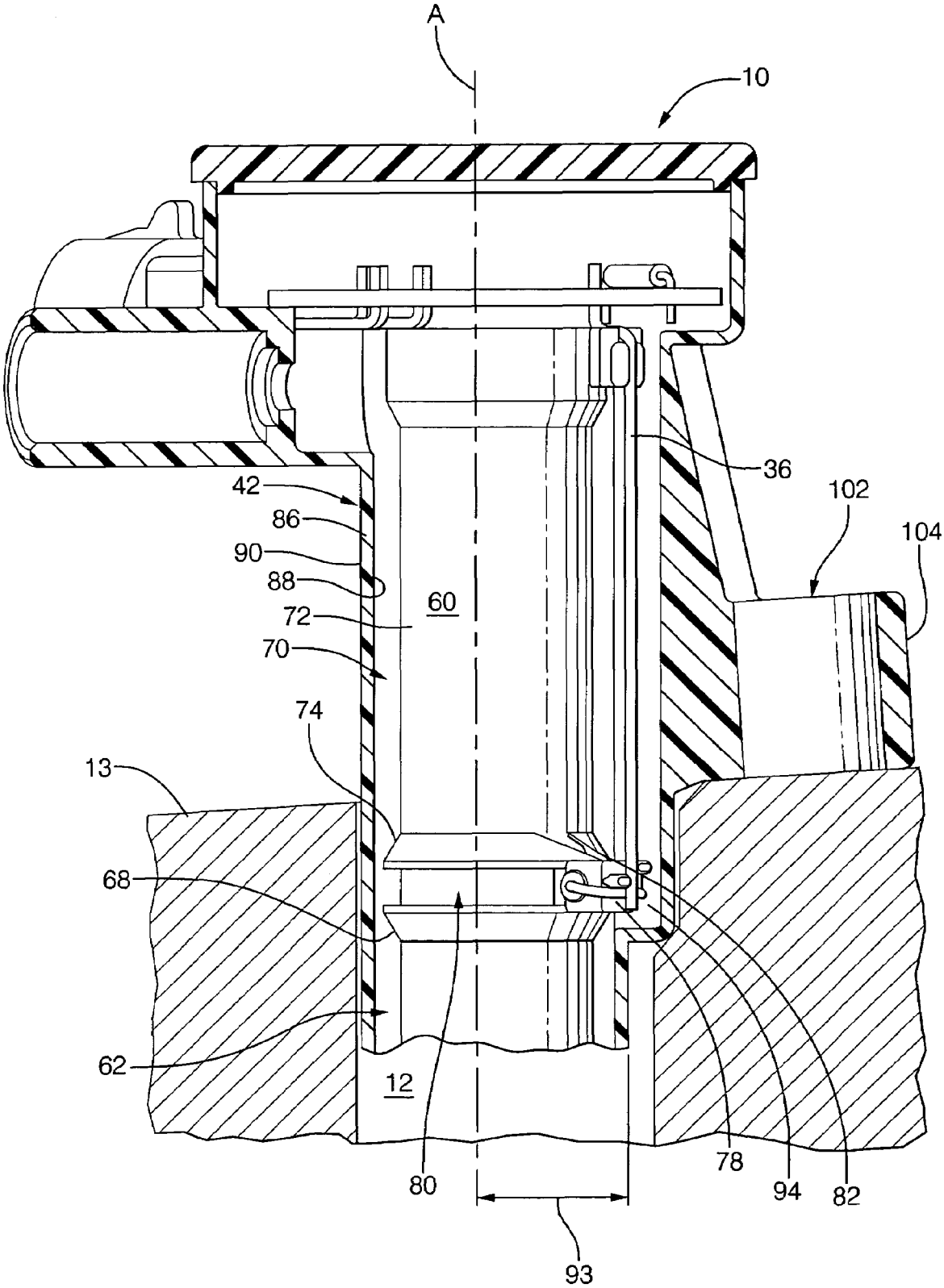
FIG. 1 is a partial, perspective view of an ignition apparatus in accordance with the present invention suitable for twin spark applications.

Referring now to the drawings wherein like reference numerals are used to identify identical components in the various views, FIG. 1 is a partial, perspective view of an ignition apparatus 10 in accordance with the present invention. Ignition apparatus 10 is configured for mounting in a spark plug well 12 in an internal combustion engine 13. Ignition apparatus 10 is configured to provide at least two high-voltage (HV) outputs with one of such HV outputs being coupled directly to a spark plug in the spark plug well 12, and the other HV output going to a second spark plug. Ignition apparatus 10 is elongated and has a main axis associated therewith, designated "A." Before proceeding to a detailed description of the various embodiments of the present invention, however, a general overview of the two basic configurations will be set forth in connection with FIGS. 2 and 3.

Figure 2:
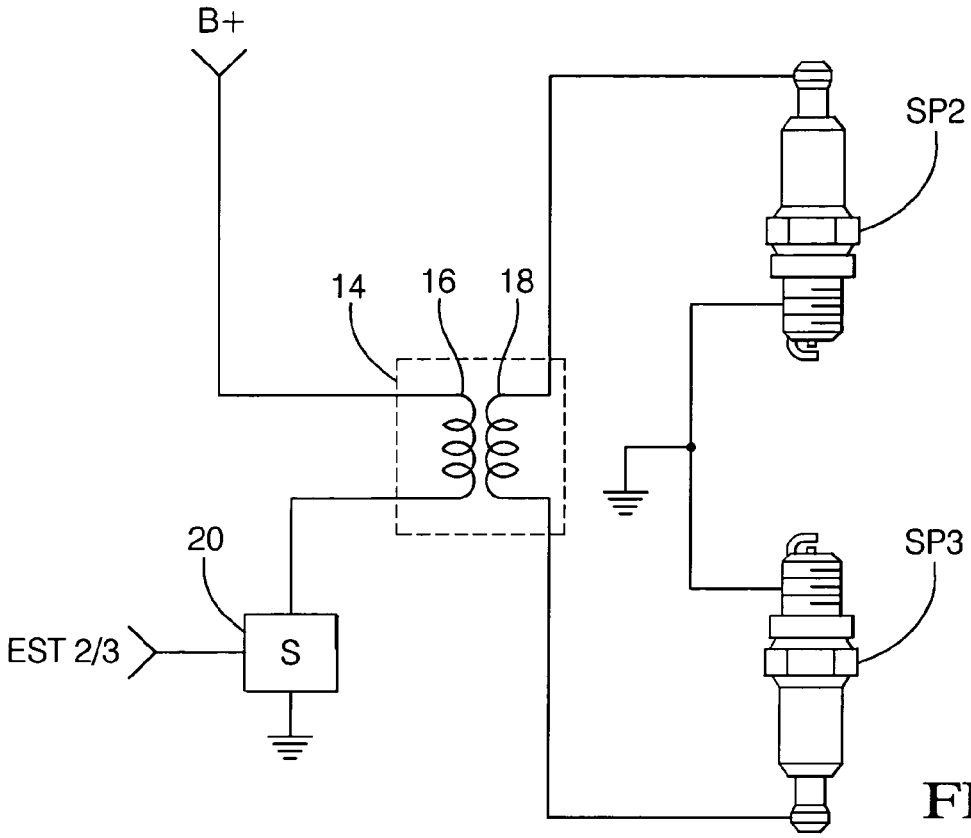
FIG. 2 is a simplified schematic and block diagram showing, in electrical form, a first embodiment of the present invention.
Figure 3:
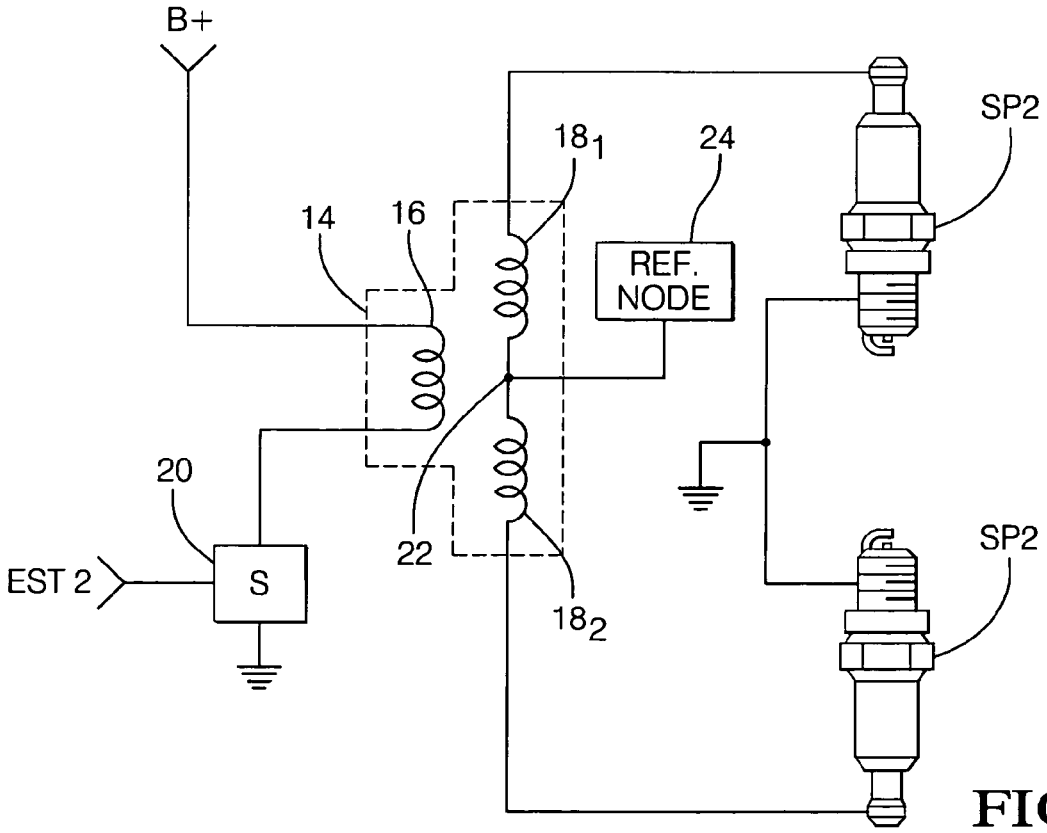
FIG. 3 is a simplified schematic and block diagram showing, in electrical form, a second embodiment of the present invention.

FIGS. 2 and 3 are simplified schematic and diagrammatic views of the basic electrical configurations of ignition apparatus 10 in two embodiments. With specific reference to FIG. 2, one configuration for ignition apparatus 10 relates to a so-called "waste" spark ignition system. FIG. 2 shows a transformer assembly 14 comprising a central, magnetically-permeable core 15 (best shown in FIG. 4), a primary winding 16, and a secondary winding 18. FIG. 2 further shows a switch 20 that is selectively opened and closed based on the state of an electronic spark timing (EST) signal. As known in the art, closing switch 20 establishes a path to ground through primary winding 16. A primary current $I_P$ is thereby established through the primary winding 16. When switch 20 is thereafter opened, the primary current $I_P$ is interrupted, causing a relatively high voltage to be produced across secondary winding 18. This high voltage across winding 18 is applied to the spark plugs, as shown.

The arrangement in FIG. 2 assumes that engine 13 has mated pairs of cylinders, for example, in FIG. 2, cylinder no. 2 and cylinder no. 3 when engine 13 is a four cylinder engine. In a "waste" spark ignition system, two sparks are generated from the high voltage produced on secondary winding 18. A first high voltage output is fed to a cylinder undergoing a compression stroke, for example, cylinder no. 2 (with a corresponding spark plug designated SP2), while a second high voltage output is provided to the mated cylinder, for example, cylinder no. 3 (with a corresponding spark plug designated SP3), which is undergoing an exhaust stroke. The two high voltage (HV) outputs from secondary winding 18, in this configuration, are of opposite electrical polarity. In the waste spark ignition system shown schematically in FIG. 2, secondary winding 18 is wound essentially as a single portion all having the same relative winding orientation. That is, the secondary winding 18 in FIG. 2 may be wound entirely in either a clockwise (CW) orientation or a counter-clockwise (CCW) orientation. The opposite polarity sparks are desired for a waste spark system but may also be used for a system with both sparks going to the same cylinder. The dual negative spark is only desired to provide the same polarity so that if long life spark plugs with premium cathode materials, such as platinum, are used the premium material only needs to be on one electrode, lowering the cost of the spark plugs. The dual negative spark cannot be used on a waste spark system because the exhaust gap breaks down significantly before the compression gap and the center tap allows current to flow through the half of the secondary going to the exhaust gap. This current effectively acts as an eddy current limiting the secondary voltage available to the compression gap to about 50% of its original value. Even when the dual negative sparks are going to the same cylinder there is some imbalance in the breakdown and burn voltages. This imbalance lowers the efficiency of the system. To minimize the effect of the imbalance on the performance of the system, the magnetic coupling between the two secondary halves should be minimized. The pencil coil magnetic configuration yields much less coupling between the two secondaries than a conventional ignition coil and therefore operates more efficiently into this imbalanced load.

A pencil coil may be characterized as having a magnetic configuration wherein the central core, the primary and secondary windings and the outer core or shield are substantially axially co-extensive along the main longitudinal axis "A." Substantially axially co-extensive means at least greater than 50% overlap between at least the central and outer cores, more preferably greater than about 90% and as shown (e.g., FIG. 7) about 100% overlap.

FIG. 3 shows an alternate configuration for ignition apparatus 10 where the secondary winding 18 includes a first portion $\mathbf{18}_1$ and a second portion $\mathbf{18}_2$. The relative winding orientation of the first and second portions $\mathbf{18}_1$ and $\mathbf{18}_2$ are opposite in nature, i.e., the first portion $\mathbf{18}_1$ is wound in one of either the CW or CCW orientations while the second portion $\mathbf{18}_2$ is wound in the opposite orientation (i.e., the other one of the CW or CCW orientations). A center tap node 22 is provided to establish a center-tapped secondary winding, and is coupled to a reference node 24, which may be either a reference ground node or a battery voltage, designated B+ in the drawings. The configuration of FIG. 3 produces two negative sparks, which may be provided to two spark plugs in the same cylinder, as shown in FIG. 3 (i.e., provided to two spark plugs, each designated SP2 for cylinder no. 2).

Figure 4:
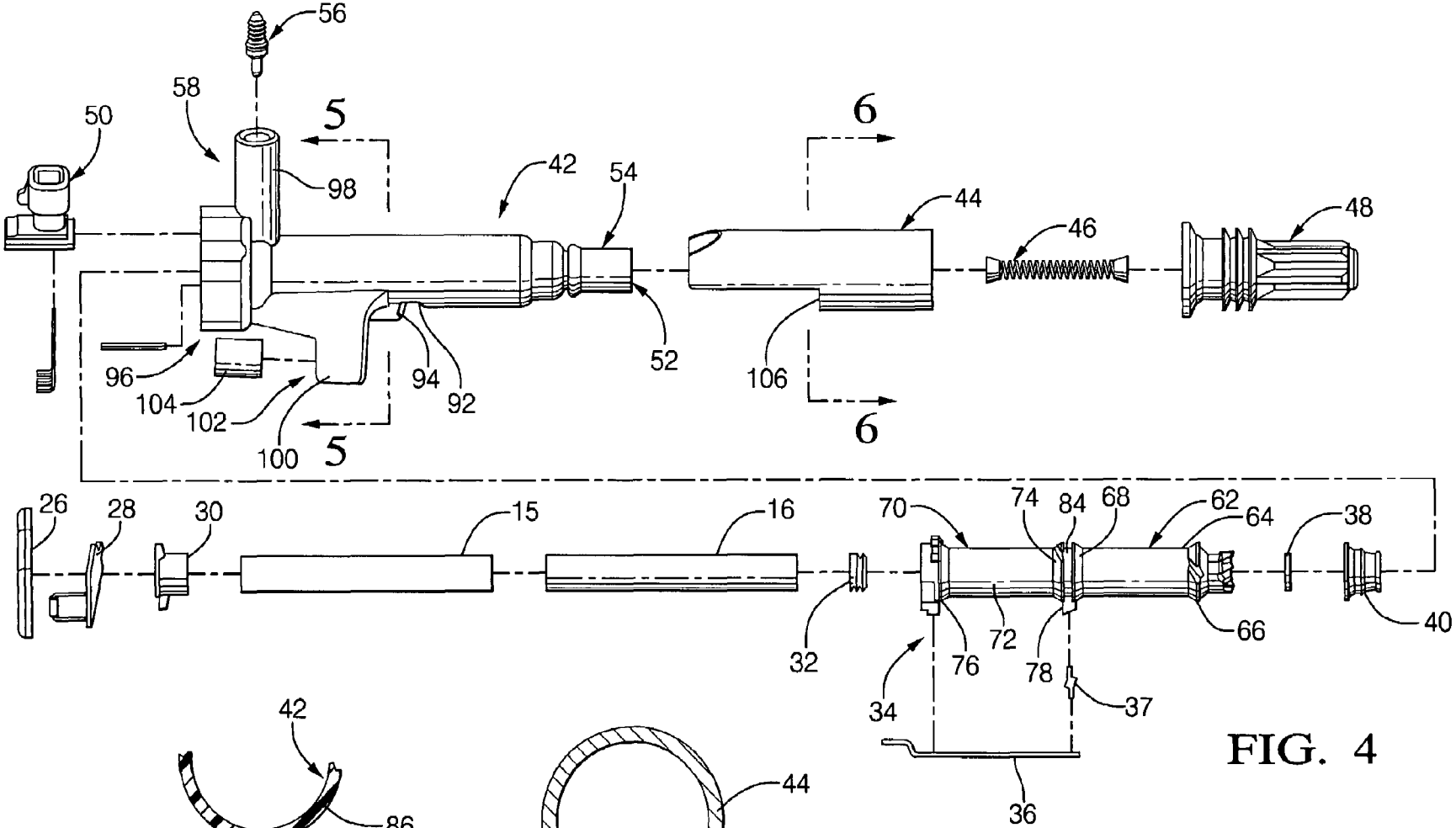
FIG. 4 is a perspective, exploded diagram view of an ignition apparatus in accordance with the present invention.

FIG. 4 is an exploded, perspective view of the subcomponents of ignition apparatus 10. FIG. 4 shows a cover 26, a mechanism such as a circuit board 28 for terminating a center tap conductor, a cap 30, central core 15, primary winding 16, a buffer cup 32, a secondary spool 34, a center tap conductor 36, an optional HV diode 37, a high-voltage terminal 38, a high-voltage cup 40, a case 42, a shield 44, a spring 46, a combination boot/seal 48 and a system connector 50.

Ignition apparatus 10 may be coupled to an ignition system (not shown), via system connector 50, which may control the primary energization circuitry to control the charging and discharging of ignition apparatus 10. Further, as shown schematically in FIGS. 2 and 3, the relatively high voltage(s) produced by ignition apparatus 10 is provided to two or more spark plugs for producing sparks across respective spark gaps thereof, which may be employed to initiate combustion in a combustion chamber of the internal combustion engine 13.

With continued reference to FIG. 4, ignition apparatus 10 is configured to produce at least two high voltage outputs, such as at a first high voltage (HV) connection 52 at a first end 54 and at a second HV connection 56 at a second end 58 of ignition apparatus 10. Second end 58 is axially opposite the first end 54.

Ignition apparatus 10 is packaged as a so-called "pencil" coil where at least a portion of the transformer assembly 14 is designed to fit inside a cylinder of less than 30 mm in diameter such as spark plug well 12. This is best shown in FIG. 1. This arrangement is in contrast to the plug top coil known in the art in which the transformer is located outside of the spark plug well. Ignition apparatus 10 is thus adapted for installation to a conventional internal combustion engine directly onto a high-voltage terminal of a spark plug via the first HV connection 52 (best shown in FIG. 4). As known, such spark plug may be retained by a threaded engagement with a spark plug opening of an engine head. The second HV connection 56 is proximate or near a second HV tower, and which provides a high voltage to another spark plug. Ignition apparatus 10 comprises in-effect a substantially slender high voltage transformer assembly including substantially, coaxially arranged primary and secondary windings and a high permeability magnetic central core 15.

With continued reference to FIG. 4, central core 15 may be elongated, and have a main longitudinal axis (e.g., coincident with main axis "A" of ignition apparatus 10 shown in FIG. 1). Core 15 may be a conventional core known to those of ordinary skill in the art. Core 15 may therefore comprise magnetically permeable material, for example, a plurality of silicon steel laminations, or, insulated iron particles compression molded to a desired shape. In the illustrated embodiment, core 15 may take a generally cylindrical shape, which defines a generally circular shape in radial cross-section.

Primary winding 16 may be wound directly onto central core 15 or may be wound onto a primary winding spool (not shown). Primary winding 16 includes first and second ends and is configured to carry a primary current $I_P$ for charging ignition coil 10 based upon the control established by an ignition system (not shown). Primary winding 16 may be implemented using known approaches and conventional materials.

The primary and secondary windings 16, 18 may both be disposed radially outwardly of central core 15, and, in the illustrated embodiment, the secondary winding 18 is wound on secondary spool 34 that is radially, outwardly of the primary windings 16 (i.e., secondary outside of primary).

Secondary winding spool 34 is configured to receive and retain secondary winding 18. Spool 34 is disposed adjacent to and radially outwardly of the central components comprising core 15 and primary winding 16, and may be in coaxial relationship therewith. Secondary winding 18 is preferably wound in a progressive wound pattern.

Secondary spool 34 includes a generally cylindrical body 60 (best shown in FIG. 1), having a first winding bay 62 defined by a first, annular winding surface 64 that is bounded by a first pair of retaining flanges 66, 68. Secondary spool 34 further includes a second winding bay 70 defined by a second, annular winding surface 72 that is bounded by a second pair of retaining flanges 74, 76. Retaining flanges 66, 68 and 74, 76 may be tapered, as taken with respect to the main longitudinal axis of the spool, as illustrated by reference to U.S. Pat. No. 6,232,863 to Skinner et al. entitled "SPOOL ASSEMBLY FOR AN IGNITION COIL," herein incorporated by reference in its entirety. Spool 34 further includes a center tap feature 78 extending from the cylindrical body 60.

Referring now to FIG. 1, secondary spool 34 further includes an axially-central region 80 in which retaining flanges 68 and 74 are disposed. Secondary spool 34 may be further configured with first and second lead-in grooves 82 and 84 (best shown in FIG. 4) that lead into the second winding bay 70. The lead-in grooves 82, 84 are respectively configured to allow winding in the second bay 70 to be either in the same or in the opposite orientations relative to the winding in the first winding bay, consistent with the two embodiments depicted in FIGS. 2 and 3. Accordingly, in one embodiment where ignition apparatus 10 is used in a waste spark ignition system, one of the lead-in grooves 82, 84 is used to allow a first portion $\mathbf{18}_1$ of the secondary winding that is in the first winding bay 62 to be continued into the second winding bay 70 to form the second portion $\mathbf{18}_2$. The first portion $\mathbf{18}_1$ and the second portion $\mathbf{18}_2$ in this arrangement are both wound in either the clockwise (CW) orientation or the counter-clockwise (CCW) orientation. This embodiment corresponds to the schematic shown in FIG. 2.

In an alternate embodiment, assuming that the first portion $\mathbf{18}_1$ of the secondary winding that is located in the first winding bay 62 is wound in one of a clockwise or counter-clockwise orientations, the other one of the lead-in grooves 82, 84 is configured to allow the second portion $\mathbf{18}_2$ to be wound in the opposite orientation, namely, the other one of the CW or CCW orientation in the second winding bay. This groove allows both ends of the first and second portions $\mathbf{18}_1$ and $\mathbf{18}_2$ of the secondary winding to enter into the central region 80, to be coupled together at a center tap node near the center tap feature 78. This arrangement may involve termination of the winding ends either to (i) a center-tap conductor 36 or (ii) to an HV diode 37 (i.e., the HV diode 37 then terminating to the center-tap conductor, as known, as seen generally by reference to U.S. Pat. No. 6,666,196 issued to Skinner et al. entitled "IGNITION SYSTEM HAVING IMPROVED SPARK-ON-MAKE BLOCKING DIODE IMPLEMENTATION" herein incorporated by reference). The center-tap arrangement corresponds to the schematic of FIG. 3.

Secondary spool 34 is formed generally of electrical insulating material having properties suitable for use in a relatively high temperature environment. For example, spool 34 may comprise plastic material such as polybutylene terephthalate (PBT) thermoplastic polyester. It should be understood that there are a variety of alternative materials which may be used for spool 34 known to those of ordinary skill in the ignition art, the foregoing being exemplary only and not limiting in nature.

With reference to FIG. 1, case 42 is configured to house transformer assembly 14 such that at least a portion of the transformer assembly 12 is disposed within spark plug well 12. Case 42 includes an axially-extending, generally annular body portion 86 in which the transformer assembly 12 is housed. The annular body portion 86 includes an inside surface 88 and an outside surface 90. The center tap node 22 (best shown schematically in FIG. 3) is formed by the ends of the secondary winding 18 that extend into the central region 80 of the secondary spool 42. In the illustrated embodiment, the center tap conductor 36 is axially-extending and radially offset from the main axis "A" by an amount designated by reference numeral 93. Case 42 still further includes a trough 94 disposed radially outwardly of the annular body portion 86 defining a channel through which the center tap conductor 36 extends.

With further reference to FIGS. 1 and 4, in the embodiment of the invention that is configured to provide a dual negative output for two spark plugs in the same cylinder (e.g., corresponding to the schematic of FIG. 3), the center tap conductor 36 is routed to the top of the ignition apparatus 10 in and through trough 94 for termination at circuit board 28. This termination may then be coupled electrically to ground or battery, as shown schematically in FIG. 3. Conductor 36 is located substantially in the shield gap. A description of this location will be elaborated upon below.

Figure 5:
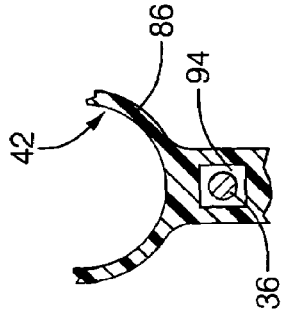
FIG. 5 is a partial, cross-sectional view of a trough portion of a case taken substantially along lines 5—5 in FIG. 4.

FIG. 5 is a partial, cross-sectional view of trough 94 taken substantially along lines 5—5 of FIG. 4. FIG. 5 shows the center tap conductor 36 extending through the trough 94 that is located radially outwardly of the annular body portion 86. It should be understood that the shield 44 and the center tap conductor 36 are nearly the same voltage relative to the high voltage associated with the secondary winding. As described above, the reference node 24, to which the center tap conductor 36 is attached, is typically ground or battery voltage B+ depending upon the termination approach. Maintaining the center tap conductor 36 in the trough 94 restrains the conductor 36 from falling below the inside diameter (I.D.) of the shield 44 so as to significantly reduce the electric field concentration set by the center tap conductor as it passes to the high voltage end of the secondary winding near the top of the ignition apparatus 10 (i.e., near top end 58).

With further reference to FIG. 4, shield 44 is generally annular in shape and is disposed radially outwardly of case 42 and, preferably, engages an outer surface 90 of case 42. Shield 44 preferably comprises electrically conductive material, and more preferably, metal, such as silicon steel or other adequate magnetic material. Shield 44 may include one or more cylindrical layers of silicon steel totaling a desired thickness. Shield 44 among other things may function as an outer magnetic "core" and provide a magnetic path for the magnetic circuit portion of ignition apparatus 10. Shield 44 may be electrically grounded.

Further, in the illustrated embodiment, shield 44 includes a notch 106. Notch 106 is configured to allow the center tap conductor 36 to extend through trough 94 to circuit board 28. Otherwise, the presence of shield 44 in that region would physically conflict with the presence of the center tap conductor 36.

Figure 6:
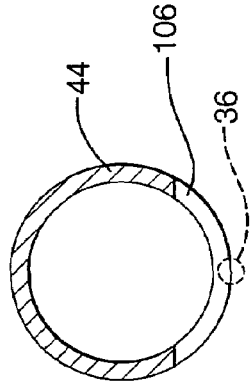
FIG. 6 is a partial, cross-sectional view showing a notch feature in a shield taken substantially along lines 6—6 in FIG. 4.

FIG. 6 is a partial cross-sectional view taken substantially along lines 6—6 in FIG. 4. FIG. 6 shows how trough 94 maintains the center tap conductor 36 (shown in phantom line) outwardly of the inside diameter (ID) of the shield 44. As described above, this location for conductor 36 is effective to reduce an electric field concentration around the conductor 36. This reduced electric field concentration has the positive effect of reducing or minimizing degradation of the case materials in ignition apparatus 10.

With continued reference to FIG. 4, case 42 further includes a connector body 96 that has an HV tower 98. The HV tower 98 provides the structure to allow the high voltage generated on second HV connection 56 to be provided to a second spark plug. Connector body 96 includes a central space in which circuit board 28 can be disposed. As described above, circuit board 28 provides a mechanism for termination of the center tap conductor 36. This electrical termination is best shown in FIG. 1.

Case 42 further includes system connector 50, which includes conductive terminals arranged for connection to a mating terminal (not shown) for communication of power and control signals between the ignition apparatus 10 and an ignition system controller or other master controller (not shown).

Case 42 may optionally further includes a mounting flange 100 containing a through bore 102 adapted in size and shape to receive a bushing 104. Mounting flange 100 provides a mechanism to allow the optional connection of ignition apparatus 10 to engine 13 or other portion of the engine compartment. Note, the ignition apparatus 10 may be relatively rigidly coupled via the direct connection of first HV output 52 to a spark plug in the spark plug well 12.

Inner surface 88 or inside diameter (ID) of case 42 is configured in size to receive and retain the assembly comprising core 15/primary winding 16/secondary spool 34/secondary winding 18. The inner surface 88 may be slightly spaced from spool 34, for example through the use of annular spacing features or the like, or may in fact engage the secondary spool 34. Case 42 may be formed of electrical insulating material, and may comprise conventional materials known to those of ordinary skill in the art (e.g., the PBT thermoplastic polyester material referred to above).

Still referring to FIG. 4, HV terminal 38, HV cup 40, and spring 46 define an HV connector assembly configured to engage a high-voltage connector terminal of a spark plug, as seen by reference to U.S. Pat. No. 6,522,232 B2 issued to Paul et al. entitled "IGNITION APPARATUS HAVING REDUCED ELECTRIC FIELD HV TERMINAL ARRANGEMENT," herein incorporated by reference in its entirety. This arrangement for coupling the high voltage developed by secondary winding 18 is exemplary only; a number of alternative connector arrangements, particularly spring-biased arrangements, are known in the art.

Boot and seal assembly 48 may comprise silicone material or other compliant, electrically insulative material, as known in the art. Assembly 48 may comprise conventional materials and construction known in the art.

In an alternate embodiment, the centerline of the transformer assembly 14 may be offset from the centerline of the HV connector/boot 48, for improved packaging.

The embodiment described above utilizes a progressive secondary winding pattern for twin spark applications. In the twin spark arrangement, ignition coil 10 mounts directly to one spark plug, with a second tower (i.e., tower 98) providing a high voltage to another spark plug. The second tower may go to a mated cylinder operating on the exhaust stroke or to a spark plug in the same cylinder operating in compression. These ignition coils may also have a center-tapped secondary winding with portions of the winding being wound in opposite directions to provide two negative sparks to two spark plugs in the same cylinder. To control and maintain a relatively small diameter, the ignition apparatus 10 described above provides that at least a part of the transformer assembly 14 is located within the spark plug well 12. In that embodiment, shield 44 is external to case 42.

Figure 7:
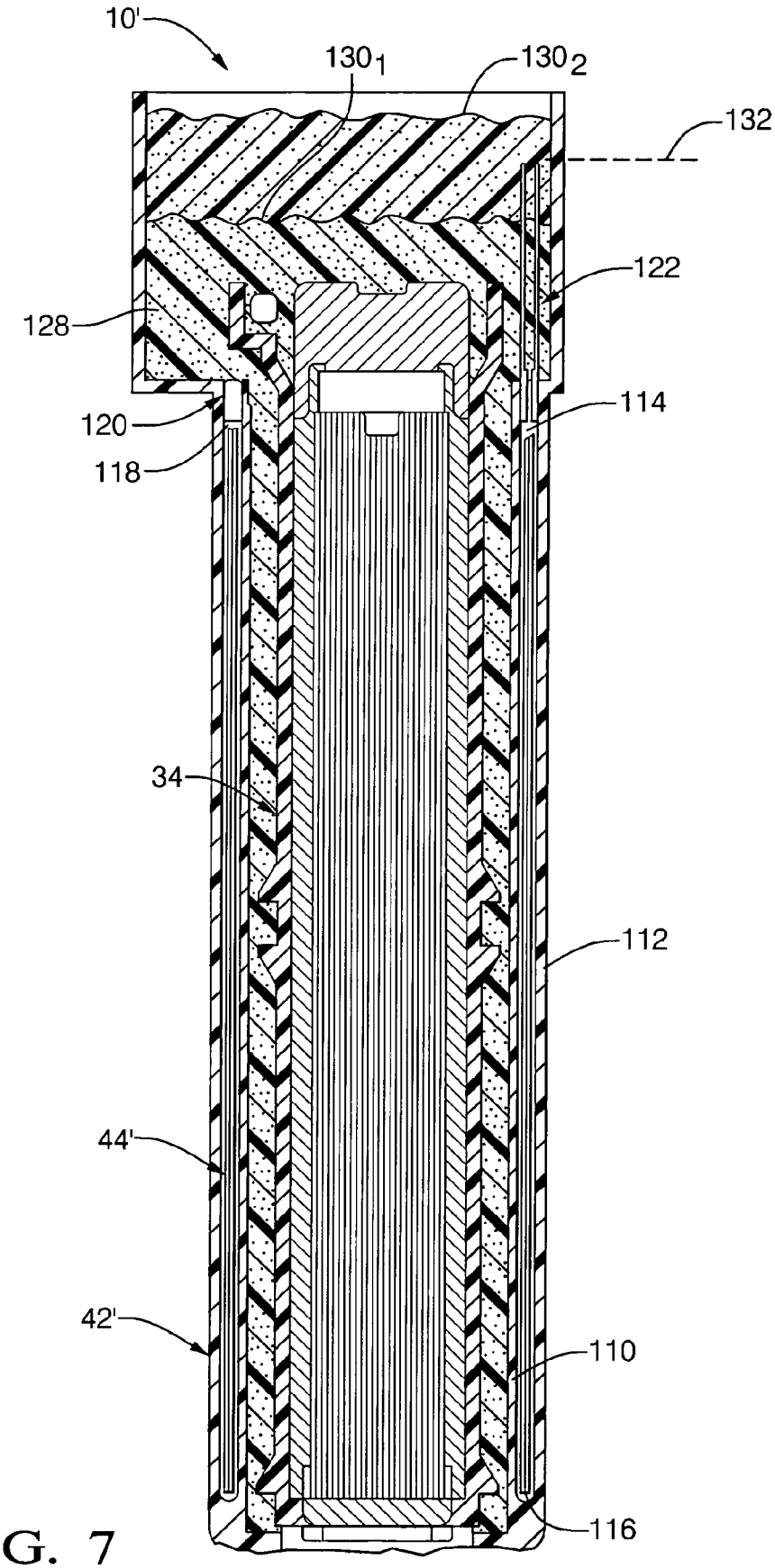
FIG. 7 is a simplified cross-sectional view of an ignition apparatus in accordance with a second aspect of the present invention having an isolated, internal floating shield.
Figure 8:
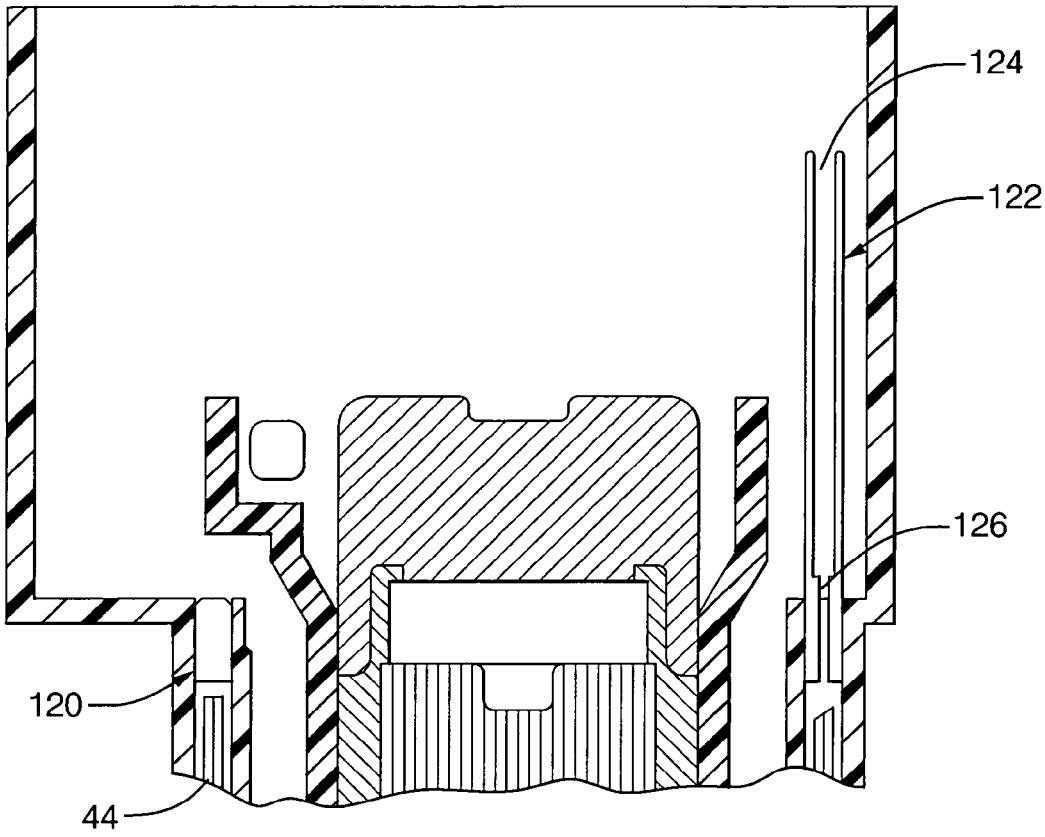
FIG. 8 is a simplified, enlarged view of a portion of FIG. 7 showing a seal in greater detail.
Figure 9:
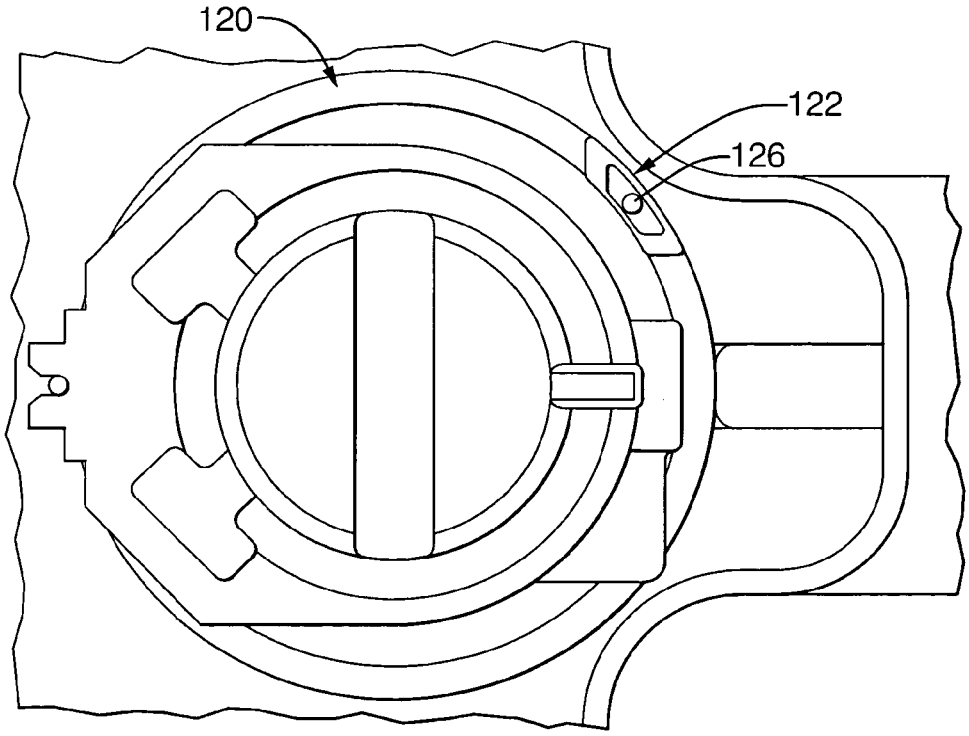
FIG. 9 is a top, plan view of the seal of FIG. 8.

Referring now to FIGS. 7–9, in accordance with another aspect of the present invention, an alternative embodiment, designated ignition apparatus 10', is provided that includes an isolated internal shield 44'.

Ignition apparatus 10' achieves the foregoing by providing a case 42' that includes an inner, annular wall 110, and an outer, annular wall 112 that is spaced radially outwardly from inner wall 110 so as to define a shield chamber 114 therebetween. The shield chamber 114 is closed at the bottom (i.e., at end 54), the closed end being designated by reference numeral 116. The shield chamber 114 further includes an opening 118 at the top or second end 58. The opening is annular in shape. Shield chamber 114 is configured in size and shape to receive or accept a shield 44'. The opening 118, being at the top of ignition apparatus 10', is towards the potting surface during potting operations (described below). Shield chamber 114 may be formed by molding case 42' as a unitary part having the chamber, as shown in FIG. 7, or it may be formed by press fitting a tube into the case to form the chamber 114 (i.e., the tube would have a smaller diameter than the inside diameter of the case such that when inserted, the chamber 114 would be formed). Shield 44' is then assembled into shield chamber 114 through opening 118.

Ignition apparatus 10' further includes an annular seal or cover 120 that is configured in size and shape to be press-fit into opening 118 to seal opening 118, preventing epoxy potting material 128 or other encapsulant from entering into the shield chamber 114. A novel feature of annular seal 120 is that it includes a snorkel 122 extending axially away from the remainder of the seal. Specifically, snorkel 122 extends axially from the shield chamber 114 to a level 132 above the epoxy surface at the time vacuum is broken, such level being designated by reference numeral $\mathbf{130}_1$.

As best shown in FIG. 8, snorkel 122 is configured to include a through-passage or bore 124 having a restriction 126. The restriction is configured to allow communication of air but not to allow communication of epoxy potting material or other encapsulant.

After epoxy 128 has been introduced to fill the case 42' to a level above the primary and secondary windings (e.g., level $\mathbf{130}_1$), the vacuum is removed and the potting chamber pressure is raised to atmospheric pressure. The snorkel 122 is configured to have an upper extent that is above the potting level at this time. This extended height or level 132 of the snorkel is higher than the first potting level $\mathbf{130}_1$.

When the pressure is raised (e.g., from a vacuum level upwards towards atmosphere), the pressure inside the shield chamber 114 also is allowed to go to atmosphere and accordingly there exists little or no pressure differential to drive epoxy 128 into the shield chamber 114. After the shield chamber 114 has reached atmospheric pressure, additional epoxy material 128 is added to top off the ignition apparatus 10'. For example, additional epoxy potting material may be added to reach a second level, designated $\mathbf{130}_2$ (best shown in FIG. 7). The epoxy potting material 128 thus covers the top of snorkel 122 to seal the chamber 114 from outside material and influences. Restriction 126 in the snorkel air path 124 is configured to allow air to pass but not epoxy potting material 128. The axial length of shield 44' is configured such that under thermal expansion of the case, shield 44' never touches the top or bottom of the shield chamber 114 at the same time, so therefore little or no mechanical stresses are applied from shield 44' to case 42'.

Shield 44', in the embodiment shown in FIGS. 7–9, may be allowed to electrically float between the secondary voltage and the external ground voltage. This electrical arrangement reduces the magnitude of the electric field across the walls of the shield chamber 114 (e.g., case), thereby allowing for thinner walls, and reducing the overall diameter with respect to the embodiment of FIGS. 1–6. A more specific description of the advantages of a floating shield may be seen by reference to U.S. Pat. No. 6,463,918 issued to Moga et al. entitled "IGNITION APPARATUS HAVING AN ELECTRICALLY FLOATING SHIELD," herein incorporated by reference.

FIG. 9 is a top plan view of seal 120, and shows the top opening of air passage 124.

In a yet further alternative embodiment, snorkel 122 is allowed to remain above the epoxy potting level through the cure phase, after which the case is closed through the use of cover 26.

The invention claimed is:

1. A pencil coil ignition apparatus comprising:

a pencil coil transformer assembly including a central core, a primary and a secondary winding, and an outer core, said central core being elongated and having a main axis, said primary and secondary windings being radially outwardly of said central core;

a case configured to house said transformer assembly, said case including a first high-voltage (HV) connection at a first end thereof configured for direct mounting on a spark plug, said case further including a second HV connection at a second end thereof opposite said first end.

2. The apparatus of claim 1 wherein said outer core comprises a magnetically permeable shield.

3. The apparatus of claim 2 wherein said central core and said shield are substantially axially coextensive.

4. The apparatus of claim 2 further including a secondary spool configured to receive and retain said secondary winding wound in a progressive winding pattern.

5. The apparatus of claim 4 wherein said secondary winding includes a first and a second end connection coupled respectively to said first and second HV connections.

6. The apparatus of claim 4 wherein said secondary spool includes a generally cylindrical body with (i) a first winding bay defined by a first, annular winding receiving surface bounded by a first pair of retaining flanges and (ii) a second winding bay defined by a second, annular winding receiving surface bounded by a second pair of retaining flanges.

7. The apparatus of claim 6 wherein said first winding bay includes a first portion of said secondary winding and said second winding bay includes a second portion of said secondary winding, said secondary spool including an axially central region wherein respective ones of said first and second pairs of retaining flanges are disposed in said central region.

8. The apparatus of claim 7 wherein said centrally disposed one of said second pair of retaining flanges includes at least a first and a second winding bay lead-in groove wherein said first lead-in groove is configured to allow said first portion of said secondary winding wound in said first winding bay to be continued into said second portion of said secondary winding would in said second winding bay wherein said first portion and said second portion of said secondary winding are both wound in one of a clockwise (CW) orientation and a counterclockwise (CCW) orientation.

9. The apparatus of claim 7 wherein said secondary spool includes a center tap feature configured to allow said first and second portions of said secondary winding to be coupled together at a center tap node, said first portion of said secondary winding being wound in one of a clockwise (CW) and counter-clockwise (CCW) orientation in said first winding bay, said centrally disposed one of said second pair of retaining flanges including at least first and second winding bay lead-in grooves wherein said second lead-in groove is configured to allow said second portion of said secondary winding to enter said second winding bay to be wound in the other one of said CW and CCW orientations.

10. The apparatus of claim 9 wherein said case includes an axially-extending, generally annular body portion in which said transformer assembly is housed, said center tap conductor axially-extending and radially offset from said main axis, said case further including a trough disposed radially outwardly of said annular body portion defining a channel through which said center tap conductor extends.

11. The apparatus of claim 10 wherein said case further includes a connector body extending from said annular body portion, said connector body including said second HV connection, said connector body further including a system connector having conductive terminals for communication of power and control signals to said apparatus, said connector body further including a mechanism for electrical termination of said center tap conductor.

12. The apparatus of claim 10 wherein said shield is annular in shape and includes a notch to allow for said center tap conductor.

13. The apparatus of claim 12 wherein said trough is further configured to maintain said center tap conductor radially outwardly of a footprint established by said annular-shaped shield.

14. The apparatus of claim 2 wherein said case includes an annular body portion comprising an inner wall and an outer wall spaced radially outward of said inner wall to define a shield chamber there between, said shield chamber being closed at said first end of said apparatus and having an opening at said second end of said apparatus, said shield chamber being configured to receive said shield.

15. The apparatus of claim 14 further including an annular seal configured to close said opening of said shield chamber, said annular seal including a snorkel that extends axially relative to a remainder of said seal, said snorkel including a through-bore for providing communication between said shield chamber and an external atmosphere.

16. The apparatus of claim 15 wherein said through-bore of said snorkel includes a restriction configured to (i) permit communication of air between said shield chamber and said external atmosphere but (ii) prevent flow of an epoxy potting material through the through-bore into the shield chamber.

17. A pencil coil ignition apparatus comprising:

a pencil coil transformer assembly including a central core, a primary and a secondary winding, and an outer core, wherein said outer core comprises a magnetically permeable shield, said central core being elongated and having a main axis, said primary and secondary windings being radially outwardly of said central core;

a case configured to house said transformer assembly, said case including a first high-voltage (HV) connection at a first end thereof configured for direct mounting on a spark plug, said case further including a second HV connection at a second end thereof opposite said first end, wherein said case includes an annular body portion comprising an inner wall and an outer wall spaced radially outward of said inner wall to define a shield chamber there between, said shield chamber being closed at said first end of said apparatus and having an opening at said second end of said apparatus, said shield chamber being configured to receive said shield; and an annular seal configured to close said opening of said shield chamber, said annular seal including a snorkel that extends axially relative to a remainder of said seal, said snorkel including a through-bore for providing communication between said shield chamber and an external atmosphere, wherein said through-bore of said snorkel includes a restriction configured to (i) permit communication of air between said shield chamber and said external atmosphere but (ii) prevent flow of an epoxy potting material through the through-bore into the shield chamber.

* * * * *